US012539013B2

(12) United States Patent
Nourbakhsh

(10) Patent No.: US 12,539,013 B2
(45) Date of Patent: Feb. 3, 2026

(54) DISHWASHER MOISTURE REMOVAL SYSTEM

(71) Applicant: BBY Solutions, Inc., Richfield, MN (US)

(72) Inventor: Farhad Nourbakhsh, Apple Valley, MN (US)

(73) Assignee: BBY Solutions, Inc., Richfield, MN (US)

( * ) Notice: Subject to any disclaimer, the term of this patent is extended or adjusted under 35 U.S.C. 154(b) by 142 days.

(21) Appl. No.: 18/322,733

(22) Filed: May 24, 2023

(65) Prior Publication Data

US 2024/0389827 A1 Nov. 28, 2024

(51) Int. Cl.
*A47L 15/42* (2006.01)
*A47L 15/48* (2006.01)

(52) U.S. Cl.
CPC ..... *A47L 15/4217* (2013.01); *A47L 15/4209* (2016.11); *A47L 15/4219* (2013.01); *A47L 15/48* (2013.01); *A47L 2501/01* (2013.01); *A47L 2501/03* (2013.01)

(58) Field of Classification Search
CPC ..... A47L 15/483; A47L 15/00–508
See application file for complete search history.

(56) References Cited

U.S. PATENT DOCUMENTS

| | | | | |
|---|---|---|---|---|
| 8,679,261 | B2 | 3/2014 | Brunswick | |
| 10,722,100 | B2 | 7/2020 | Heinle | |
| 2010/0258145 | A1* | 10/2010 | Heissler | A47L 15/0034 134/18 |
| 2020/0281437 | A1* | 9/2020 | Fallert | B08B 3/08 |

FOREIGN PATENT DOCUMENTS

KR 20130087847 A 8/2013

OTHER PUBLICATIONS

Bengtsson and Berghel, Concept study of a new method for drying dishware in a head pump dishwasher, article, pp. 2-3, Environmental and Energy Systems, Karlstad University, Sweden.

* cited by examiner

*Primary Examiner* — Spencer E. Bell
(74) *Attorney, Agent, or Firm* — Forsgren Fisher McCalmont DeMarea Tysver LLP; James M. Urzedowski; Daniel A. Tysver

(57) ABSTRACT

A dishwasher appliance is provided, and includes an external housing containing a tub for receiving dishes. The dishwasher configured to receive water from a water source of a dwelling via an external supply line, which includes a valve for directing water between the tub and a water reservoir. Water received into the reservoir will be cooler than the water utilized in the tub to wash dishes. A water pump is connected to the reservoir so that during the drying cycle, the relatively cool water of the reservoir can be pumped through one or more conduits that are in contact with various surfaces of the tub so as to cool the tub interior and cause moisture contained therein to condense and drain out of the tub thereby efficiently enhancing the drying performance of the dishwasher.

14 Claims, 5 Drawing Sheets

PRIOR ART FIG. 1

DISHWASHER MOISTURE REMOVAL SYSTEM

TECHNICAL FIELD

Embodiments disclosed herein are directed to appliances such as dishwashers. More specifically, some embodiments are directed to dishwashers having improved moisture removal mechanisms and systems.

BACKGROUND

Known dish washing appliances are provided with an internal tub that defines an operational chamber for the washing and drying of dishes performed by various cycles of operation (e.g. washing cycle, rinsing cycle, drying cycle, etc.). Current state of the art dishwashers rely on air that is actively blown or otherwise passed through the operational chamber to remove excess water from the surface of the dishes during the drying cycle. Such dishwashers require the use of energy intensive mechanisms such as air blowers, radiant heaters, and the like to perform the drying function. Even with such mechanisms the drying cycle of many dishwashers can take hours. Such dishwashers also require the use of vents through which air can pass through the operational chamber to the outside environment of the dishwasher. Such dishwashers require excess clearance to allow the air to properly vent and are responsible for transferring unwanted heat and moisture from the dishwasher interior to its surrounding environment; resulting in residue build up and/or even encouraging the growth of mold.

In light of the above, there is a need to provide a dishwasher with improved drying characteristics that is both more energy efficient and provides a less time consuming but still effective drying cycle over existing drying mechanisms, and which also will minimize the amount of waste heat and moisture that may be blown out of any air venting that the dishwasher may be provided with.

SUMMARY

Embodiments disclosed herein are directed to a dishwashing appliance (dishwasher) which utilizes a cold water reservoir to temporarily store tap water initially drawn into the dishwasher. The stored water is pumped into one or more water channels or conduits within the walls of the internal tub during the drying cycle of the dishwasher's operation. The water pumped into the channels acts to cool the adjacent interior surface(s) of the tub, which results in the removal of moisture from the hot air within the tub causing water to condense on the sides of the tub where it may then drain out of the tub interior.

In some embodiments, the water contained in the reservoir is the water initially drawn into the dishwasher from a hot water line or the combined hot and cold water lines of a residential or commercial building. The water once contained in the reservoir is cooler and/or allowed to cool to a temperature below the internal temperature of the interior of the tub during the drying cycle.

In at least one embodiment, the water channels include a plurality of microchannels in contact with one or more walls of the tub.

In at least one embodiment, the water channels include a plurality of thermal transfer fins, which act to increase the surface area of the channel that is in contact with the tub walls.

In at least one embodiment, the water channels are embedded within the walls of the tub.

In addition to or as an alternative to the embodiments described above, in at least one embodiment the dishwasher is equipped with one or more thermoelectric coolers which are configured to transfer heat from the interior surfaces of the tub to an external surface of the dishwasher.

These aspects and others are shown in the following drawings and described in greater detail below.

DETAILED DESCRIPTION

Figure 1:
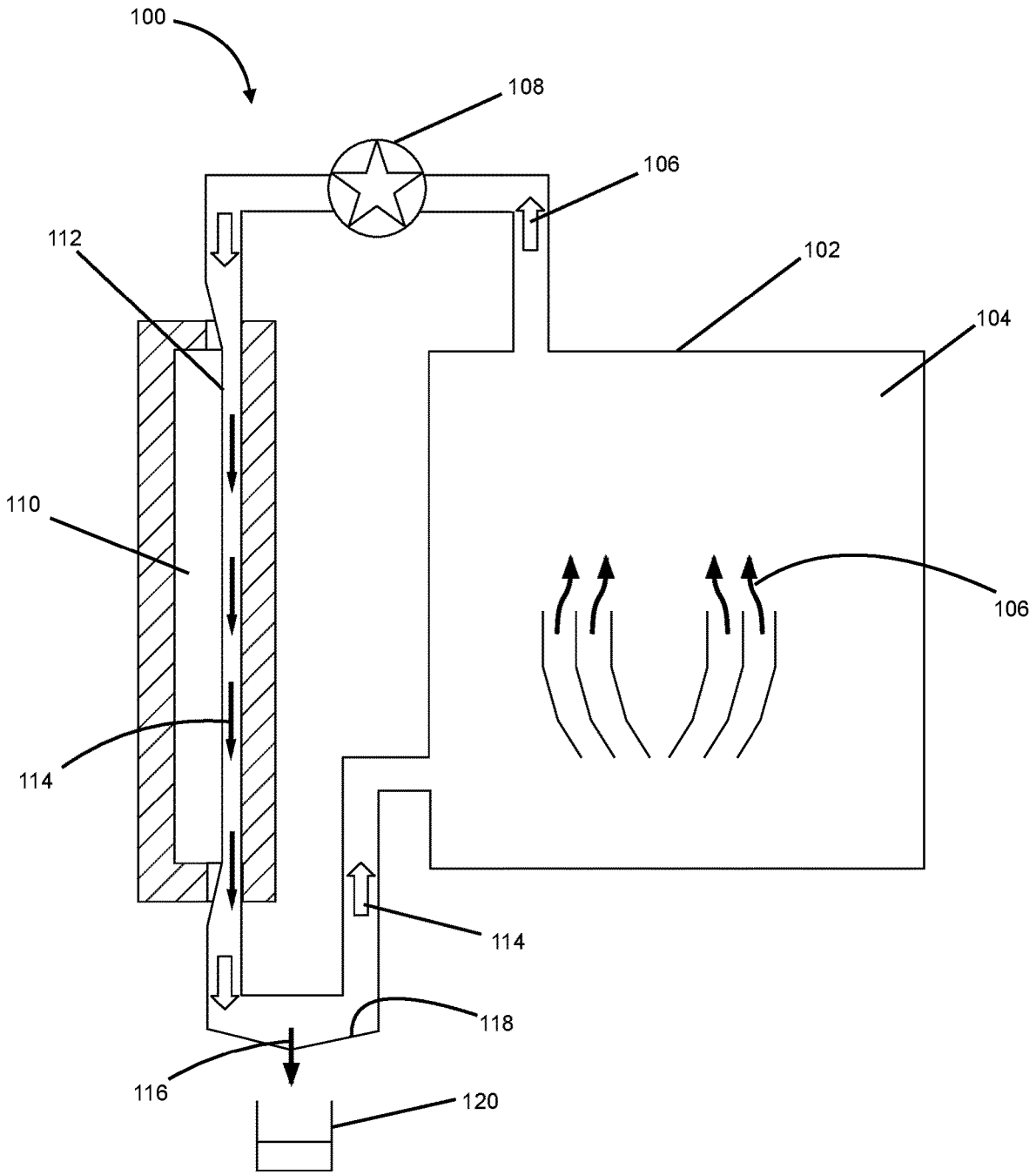
FIG. 1 is a conceptual interior view of a PRIOR ART dishwasher illustrating a conventional water condensation system.

As mentioned above, embodiments of the dishwasher disclosed herein are primarily directed to dishwasher appliances that are provided with a mechanism or system to encourage water to condense out of the dishwasher tub during the drying cycle, resulting in improved dishwasher performance in terms of drying time and energy usage among other benefits.

It should be noted however, that some known dishwashers do utilize heat pump-like systems in an attempt to cause moisture contained in the heated air of the dishwasher tub to condense out of the tub interior during the drying cycle. An example of such a known system 100 is shown in PRIOR ART FIG. 1. As depicted, such a known system 100 will include a dishwasher tub 102 whose interior 104 is heated by any sort of conventional means (via a radiant heat source, heated air blown into the tub interior via a fan, etc.). The heated air (indicated by arrows) 106 is drawn out of the interior 104 by a fan 108 and directed into close proximity of a cold water tank 110, via a conduit or conduits 112, whereupon the heated air is cooled. The now cooler air (indicated by arrows) 114 is redirected back into the tub interior 104. By this action, moisture (indicated by arrow) 116 that had been contained in the more humid warm air 106 condenses along the conduit interior 118 and is allowed to exit the system 100 via a drain 120.

In such a system, in order to ensure that moisture contained in the heated water exiting the tub interior condenses out, the water tank must be actively cooled, otherwise the passage of the heated air would quickly diminish its capacity to cool the air flow. Such a cooling system is somewhat inefficient and/or less than ideal as it will typically require the use of electricity (as well as potentially hazardous refrigerants, insulation, etc.) in order to maintain the required cooling effect.

More efficient alternatives to known dishwashers, including dishwashers equipped with heat-pump style water condenser systems of the type shown in PRIOR ART FIG. 1, are shown in the accompanying figures and described below.

Figure 2:
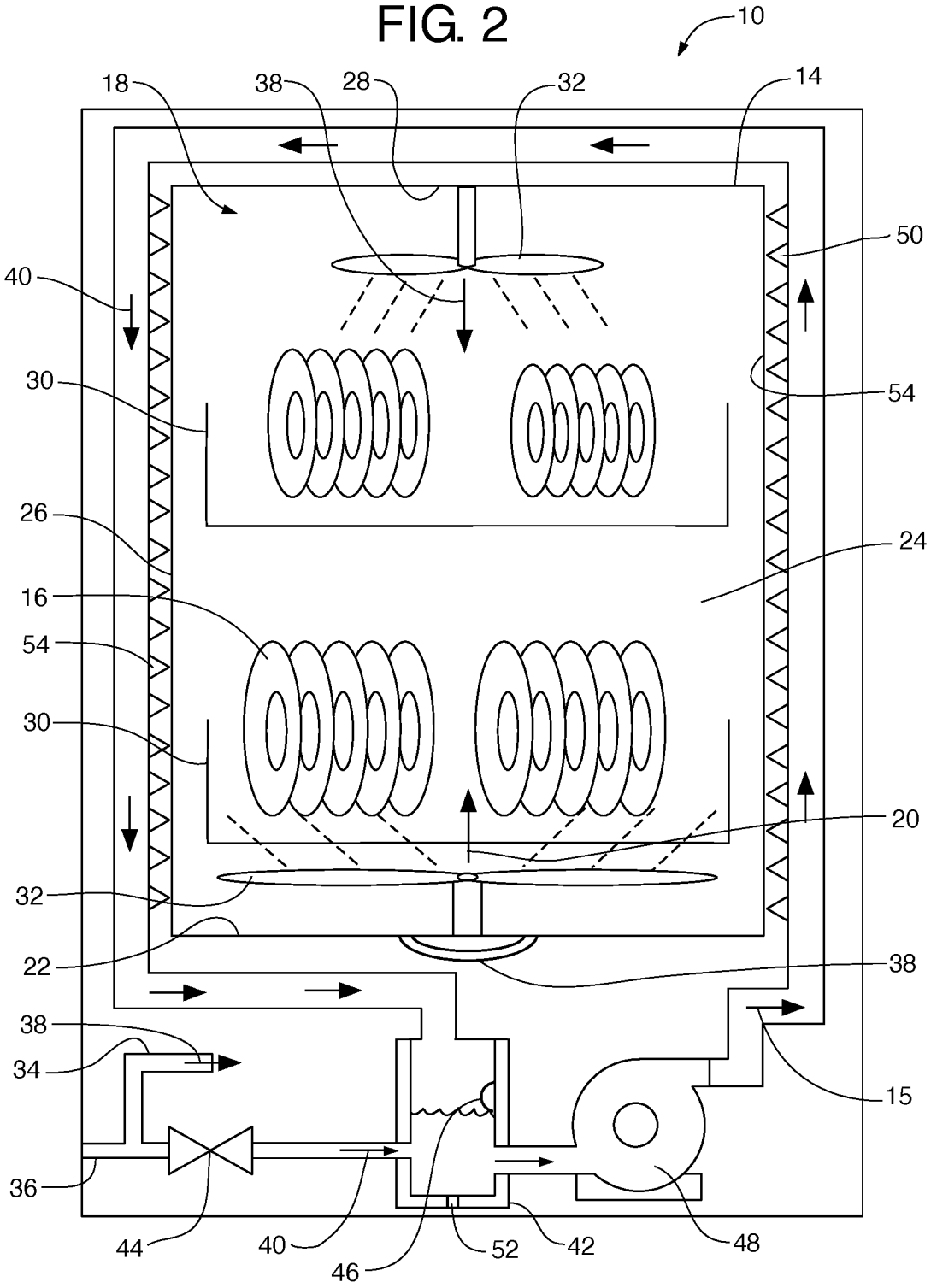
FIG. 2 is a front interior view of an embodiment of a dishwasher equipped with a water reservoir and channels, wherein the channels are equipped with thermal transfer fins.
Figure 3:
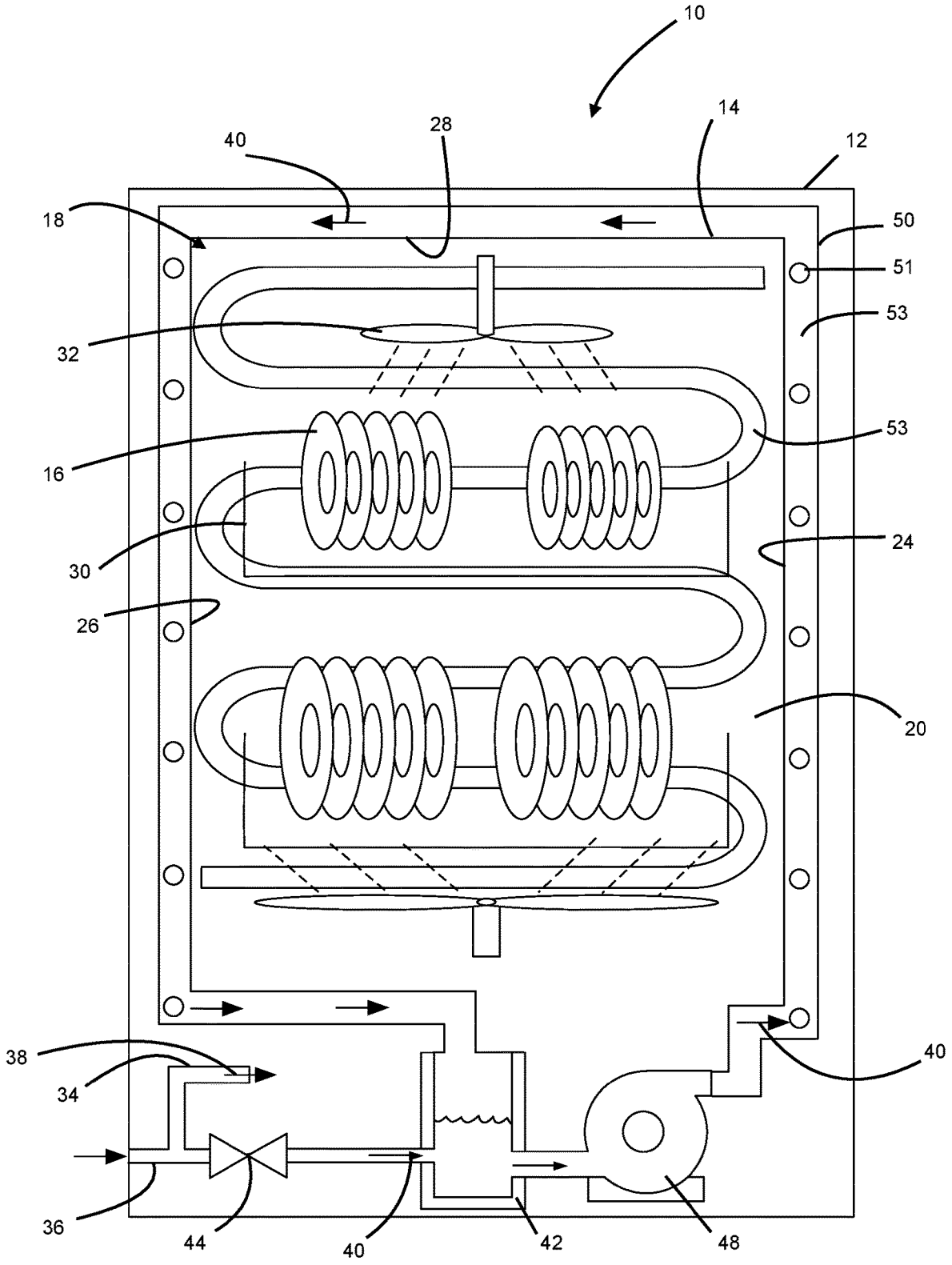
FIG. 3 is a front interior view of an embodiment of a dishwasher equipped with a water reservoir and channels, wherein the channels are embedded in the walls of the dishwasher tub.
Figure 5:
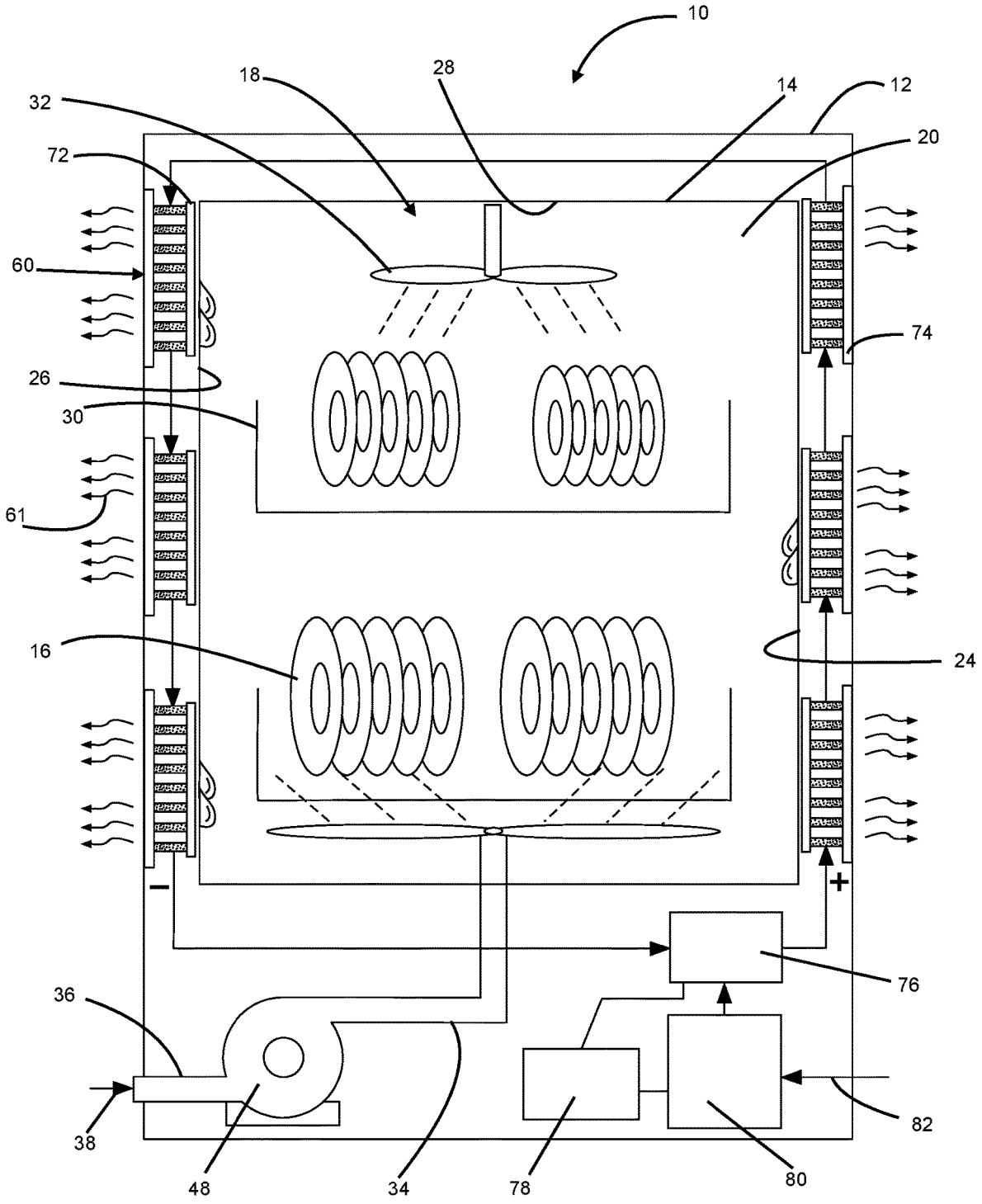
FIG. 5 is a front interior view of an embodiment of a dishwasher equipped with one or more thermoelectric coolers of the type shown in FIG. 4.

In the various embodiments shown in FIGS. 2, 3 and 5, a dishwasher 10 includes an external housing 12 which contains an internal tub 14 configured to accept dishes 16. The tub 14 is accessed in the convectional manner such as via a forward access opening that is normally covered by a water tight door (not shown). The dishwasher door is moveable in the conventional manner between an open position that allows access to the tub interior 18 and a closed position, wherein the tub 14 is sealed to allow operation of the dishwasher.

The tub interior 18 is generally box-like in shape and is defined by the aforementioned door as well as a back wall 20 opposite the door/access opening, a floor or bottom 22, first and second side walls 24 and 26, and a top 28. Interior surfaces (typically the side walls 24 and 26) of the tub 16 support one or more shelves, baskets, or similar support structures 30 that are designed to allow water and air to pass therethrough while also configured to accept and contain dishes 16 throughout the dishwasher's operational cycles.

The tub interior 18 also includes one or more spray bars 32 through which water and/or air may be passed during the various operational cycles of the dishwasher. Spray bars 32 are typically hollow structures with a plurality of openings through which water and/or air is forced through under pressure. Spray bars 32 via internal plumbing line 34 are in fluid communication with a water supply line 36 of the home, business, dwelling, etc. where the dishwasher 10 is installed.

A spray bar 32 may be fixed or rotatable relative to the surface of the tub interior 18 to which they are mounted. In some embodiments, a spray bar 32 is mounted to one or more support structures 30. In some embodiments, at least a portion of one or more support structures 30 are comprised of hollow conduits in communication with the dishwasher's internal plumbing and provided with multiple openings through which air and/or water may be forced, such that the structures 30 effectively act as spray bars 32.

In some embodiments, the tub interior 18 will include a heat source such as a radiant heater coil (not shown) or the like. In some embodiments, the dishwasher will include a water heater mechanism (not shown) in communication with the internal water supply line 34 and the spray bars 32. In at least one embodiment, such as in the examples shown in FIGS. 2 and 3, the internal water supply line 34 is in communication with the external hot water supply line 36 of the dwelling where the dishwasher 10 is installed. In these embodiments, hot water (indicated by arrow) 38 is supplied to the spray bars 32 during operation of the dishwasher's wash cycle.

In a typical dwelling where the dishwasher 10 is installed, an on-site water heater will be programed to heat the water of the hot water supply to the desired temperature. A desired water temperature for the hot water used by the dishwasher 10 during the wash cycle will typically be between 50-60 degrees Celsius.

A common aspect of most water supply systems is that even when hot water alone is called for at a faucet, tap, or in this case, when called for by the operation of the dishwasher 10, is that it takes some period of time for the called for water to reach the desired temperature. Thus, the water that is immediately received from the external water supply line 36 when hot water is called for by the dishwasher 10 will be relatively cool for a limited period of time during which this relatively cool water (indicated by arrow) 40 will flow into the dishwasher 10.

In the embodiments shown in FIGS. 2 and 3 the dishwasher 10 includes a reservoir 42 into which this relatively cool water 40 is directed. To accomplish this, the dishwasher 10, is equipped with a valve 44 that has an open position and a closed position. When the dishwasher initially calls for hot water from the external water line 36, valve 44 is in the open position so that a desired volume of this relatively cool initially received water 40 is allowed to enter and be collected in the reservoir 42. When a desired volume of cool water 40 is collected in the reservoir 42, the dishwasher actuates the valve 44 from the open position to the closed position, shutting off the flow of water into the reservoir and forcing the now sufficiently warm water into the internal plumbing of the dishwasher to supply the spray bars 32 with warm water 38.

In some embodiments, valve 44 includes a temperature sensor which actuates the valve 44 from the open position to the closed position when water 40 flowing through the valve 44 reaches a desired "hot" water temperature (e.g., between about 50 to about 60 degrees Celsius).

In some embodiments, reservoir 42 include a float switch 46 in communication with the valve 44, such that when the water 40 entering the reservoir 42 reaches a desired level or volume the float switch 46 is activated and the valve 44 is actuated from the open position to the closed position. The desired level or volume of water received into the reservoir is less than 2 gallons of water 40. In at least one embodiment, the desired volume is between 0.5 and 1 gallon of water 40.

When the reservoir 42 has received the desired amount of water 40, the valve 44 is closed, and the now warm water 38 received from the external water line 36 is redirected into the internal water line 34, which is in communication with the the spray bar(s) 32, for use during the dishwasher's washing and/or rinsing cycles. Upon completion of the washing and/or rinsing cycles, the warm water 38 is allowed to drain out of the tub 14 via the tub drain 15.

Reservoir 42 is in communication with a water pump 48. Water pump 48 is activated during the drying cycle of the dishwasher 10 to draw the relatively cool water 40 contained in the reservoir 42 into at least one cold water conduit 50.

Conduit 50 defines a closed loop extending from the water pump 48 to the reservoir 42. For most of its length, conduit 50 extends away from the water pump 48 and into the space between the exterior housing 12 and the tub 14. Along at least some of its length, conduit 50 is immediately adjacent (in contact with) to the sides of the tub 14, including the back 20, interior walls 24 and 26, and top 28. The cold water 40 passing through the conduit 50 during the drying cycle acts to cool the interior sides of the tub 14, which causes the moisture that remains in the tub interior 18 following the washing and/or rinse cycles to condense on the various interior surfaces of the tub 14 and drain out of the tub interior 18 via the tub drain 15.

In some embodiments, some portion of the conduit 50 is in contact with the external housing 12 to better radiate heat captured from the tub 14. In some embodiments, the surfaces of the conduit 50 not in contact with the tub 14 are insulated in order to allow the water 40 flowing through the conduit 50 to retain as much of the heat captured from the tub 14 as possible until it reaches the reservoir 42.

For purposes of illustration only, conduit 50, as shown in FIG. 2 is depicted as a large channel for passage of water 40 along the interior sides and top of the tub 14. In at least one embodiment, conduit 50 is comprised of a plurality of channels of various sizes distributed along and adjacent to as much of the perimeter of the tub 14 as is practical. For example, in the embodiment shown in FIG. 3, conduit 50 is shown to include a primary conduit 51 that extends around the sides 24 and 26, top 28, and back 20 of the tub 14; this primary conduit 51 is in communication with several sub-conduits 53 that branch off of the primary conduit 51 at a plurality of locations and in various directions in order to increase the potential area of contact between the primary conduit 51 and sub-conduits 53 with the various surfaces of the tub 14.

In some embodiments, the sub-conduits 53 include interconnected microchannels embedded into the walls 24 and 26, top 28 and back 20 of the tub 14.

In some embodiments, conduit 50 also extends into the door of the dishwasher.

In some embodiments, during the drying cycle air is directed toward the dishes 16 via the spray bar(s) 32 and/or via one or more ducts or vents (not shown) driven by a blower or other known mechanism. This directed air assists in blowing any moisture that may condense on the dishes 16 to be blown off of the dishes 16 and into the drain 15.

Once the water 40 has been passed through the conduits 50, the water is returned to the reservoir 42 for re-use by the dishwasher 10 or drained from the reservoir 42 via reservoir drain 52.

In some embodiments, such as in the example shown in FIG. 2, at least a portion of the conduit 50 includes a plurality of heat sinks 54 which may be in the form of any sort of raised rib, collar, tab, texture or other surface projection that act to increase the surface contact with the tub 14, such that the potential transfer of heat between the conduit 50 and tub 14 is increased or maximized.

Figure 4:
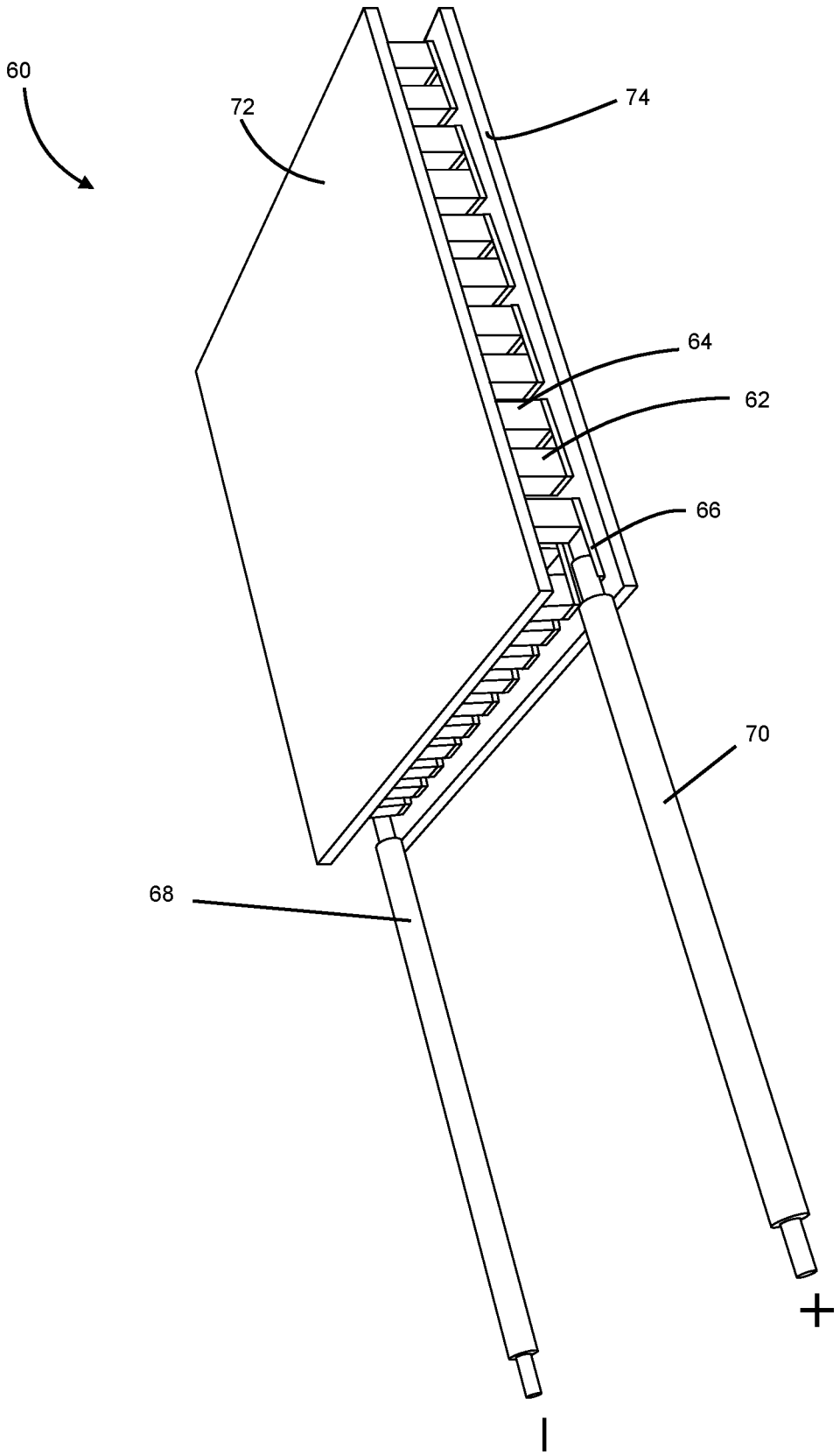
FIG. 4 is a perspective view of an exemplary thermoelectric cooler.

In some embodiments, the dishwasher 10 employs one or more thermoelectric coolers 60, an example of which is shown in FIG. 4. Thermoelectric coolers (TEC) 60 do not rely on or require the use of water to act as the heat transfer agent, and provide direct cooling to the surfaces of the tub 14 such as in the manner depicted in FIG. 5.

Continuing with the example TEC 60 shown in FIG. 4, the TEC 60 is essentially a solid state heat pump that functions in accordance with the Peltier Effect. In the example shown in FIG. 4 the TEC 60 is comprised of n and p type semiconductors 62 and 64 that are in contact with a conducting tab 66, which is in electrical communication with positive and negative electrical wiring leads 68 and 70. These components are sandwiched between a cold-side substrate 72 and a hot-side substrate 74.

In operation, a current is passed (via electrical leads 68 and 70) through one or more pairs of semiconductors from n-type 62 to p-type 64 results in a decrease in temperature at the cold-side substrate 72 resulting in the absorption of heat from the environment. The heat is carried along the semiconductors by electron transport and released on the opposite hot-side substrate 74 as the electrons move from a high- to low-energy state. In this manner a TEC 60 acts as a solid state heat pump. Typically, the substrates 72 and 74 are constructed from aluminum, ceramic or some other durable but heat conductive material.

In the embodiment of the dishwasher 10, shown in FIG. 4, the dishwasher 10 employs a plurality of TECs 60, which are positioned such that the cold-side substrate 72 of each TEC 60 is in direct contact with the side walls 24 and 26 of the tub 14. The hot-side substrate 74 of each TEC is in direct contact with the external housing 12 of the dishwasher 10. When the TECs 60 are subjected to an electric current, each TEC 60 will begin cooling the sides of the tub 14 and radiating heat (indicated by arrows 61) externally away from the dishwasher 10 in accordance with the operational principles described above.

In some embodiments, one or more TECs 60 are incorporated into the back 20 and/or top 28 of the tub 14 in the same manner as is shown in FIG. 5 with regard to the presence of TECs 60 in the sides 24 and 26.

The TEC 60*s* are in electrical communication with a TEC controller 76 and a processor 78 which determines when and for how long electrical current is to be applied to the TECs 60, such as for example, throughout the drying operational cycle previously described. The electrical current is provided by a AC/DC power supply 80 which is in communication with the power supply of the dwelling (indicated by arrow 82) into which the dishwasher 10 is installed.

As will be understood, a dishwasher 10 equipped with TECs 60, such as in the manner of the embodiment shown in FIG. 5, will have no need of a dedicated water based condensation system such as in the embodiments shown in FIGS. 2 and 3. Instead, the dishwasher 10 of the type shown in FIG. 5 will have a more conventional plumbing setup whereby water 38 called for by the dishwasher 10 for the washing and/or rinsing operational cycles from the dwelling water supply line 36 is transported directly into the tub interior 18 via the internal supply line 34 and/or by a water pump 48 (to provide additional pressure if desired).

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A dishwasher appliance having a dishwashing cycle and a drying cycle, the dishwasher appliance comprising:

an external housing;

a tub positioned within the external housing, the tub having two sides, a back, a top, and a bottom, the two sides, the back, the top, and the bottom, defining a tub interior, the tub interior configured to receive dishes;

an external water supply line and an internal water supply line, the external water supply line configured to receive water from a water source of a dwelling, the internal water supply line being in fluid communication with the external water supply line, the external water supply line having a valve, the valve being actuatable between an open position and a closed position;

a water reservoir in communication with the external water supply line, in the open position water received from the external water supply line is directed into the water reservoir, in the closed position water received from the external water supply line is directed into the internal water supply line, the internal water supply line being in fluid communication with the tub interior;

a water pump, the water pump in fluid communication with the water reservoir;

at least one conduit, the at least one conduit being in fluid communication with the water pump and the water reservoir and defining a closed loop therebetween, the at least one conduit extending from the water pump to the water reservoir between the tub and the external housing, at least a portion of the at least one conduit being immediately adjacent to a portion of the tub.

2. The dishwasher appliance of claim 1, further comprising at least one spray bar, the at least one spray bar in fluid communication with the internal water supply line and positioned within the tub interior.

3. The dishwasher appliance of claim 1, wherein the water received from the external water supply line that is directed into the water reservoir when the valve is in the open position is a first temperature, and the water received from the external water supply line that is directed into the internal water supply line when the valve is in the closed position is a second temperature, wherein the second temperature is warmer than the first temperature.

4. The dishwasher appliance of claim 3, wherein the second water temperature is between 50 degrees and 60 degrees Celsius.

5. The dishwasher appliance of claim 3, wherein the valve comprises a temperature sensor, the temperature sensor configured to actuate the valve from the open position to the closed position when the temperature of the water received from the external water supply line is above 50 degrees Celsius.

6. The dishwasher appliance of claim 3, further comprising a float sensor, the float sensor positioned in the water reservoir, the float sensor being in operative communication with the valve, whereby when a desired volume of water is received into the water reservoir, the float sensor actuates the valve from the open position to the closed position.

7. The dishwasher appliance of claim 3, wherein when the dishwasher is in the drying cycle, the water pump is configured to pump water of the first temperature contained within the water reservoir into the at least one conduit.

8. The dishwasher appliance of claim 3, wherein the water reservoir is configured to receive no more than two gallons of water.

9. The dishwasher appliance of claim 7, wherein the at least a portion of the at least one conduit is immediately adjacent to the two sides and the top of the tub.

10. The dishwasher appliance of claim 7, wherein the at least a portion of the at least one conduit is immediately adjacent to the two sides, the back of the tub, and the top of the tub.

11. The dishwasher appliance of claim 10, further comprising a plurality of heat sinks, the plurality of heat sinks extending from the at least a portion of the at least one conduit and are in direct contact with the tub.

12. The dishwasher appliance of claim 10, wherein the at least a portion of the at least one conduit comprises a primary conduit and a plurality of sub-conduits, the plurality of sub-conduits extend from the primary conduit at a plurality of locations.

13. The dishwasher appliance of claim 12, wherein the plurality of sub-conduits are microchannels defined by the two sides, the back, and the top of the tub.

14. The dishwasher appliance of claim 1, wherein when the dishwasher appliance begins the dishwashing cycle, the valve is in the open position and the dishwasher calls for hot water from the external water line;

a desired volume of the water received from the external water supply line that is directed into the water reservoir is determined and the valve is actuated to the closed position;

the water received from the external water supply line that is directed into the internal water supply line enters the tub interior;

when the dishwasher appliance begins the drying cycle, the desired volume of the water is pumped by the water pump from the water reservoir into the at least one conduit, and back to the water reservoir.

* * * * *